United States Patent [19]

Petroff

[11] 4,369,335

[45] Jan. 18, 1983

[54] TWO-CHANNEL, FOUR LOUDSPEAKER-COMPONENT ENHANCED STEROPHONIC SYSTEM

[76] Inventor: Michael L. Petroff, 11436 Victoria Ave., Los Angeles, Calif. 90066

[21] Appl. No.: 170,523

[22] Filed: Jul. 21, 1980

[51] Int. Cl.[3] ..... H04S 1/00

[52] U.S. Cl. ..... 179/1 GA; 179/1 G

[58] Field of Search ..... 179/1 GA, 1 G, 1 GP, 179/1 GQ, 1 E; 369/87, 89

[56] References Cited

U.S. PATENT DOCUMENTS

| | | | |
|---|---|---|---|
| 3,016,424 | 1/1962 | Franke | 179/1 G |
| 3,627,948 | 12/1971 | Nichols | 179/1 GA |
| 3,637,938 | 1/1972 | Kuhlow et al. | 179/1 G |

FOREIGN PATENT DOCUMENTS

| | | | |
|---|---|---|---|
| 2709952 | 9/1978 | Fed. Rep. of Germany | 179/1 GA |
| 2037130 | 7/1980 | United Kingdom | 179/1 GA |

*Primary Examiner*—Douglas W. Olms
*Attorney, Agent, or Firm*—W. Edward Johansen

[57] ABSTRACT

The present invention is an improved two-channel, four loudspeaker-component enhanced stereophonic system which includes a pair of front loudspeaker systems, a pair of rear loudspeaker systems and a pair of speaker enclosures into each of which one of the front loudspeaker systems and one of the rear loudspeaker systems are placed. The enhanced stereophonic system also includes two electronic matrix networks which interconnect the input terminals of each front loudspeaker system to the left and right channel amplifier output terminals, respectively, and which also interconnect the positive input terminal of each rear loudspeaker system to the left and right channel positive amplifier output terminals, respectively. The electronic matrix networks include a first high-pass filter and a second high-pass filter each of which has an input terminal and an output terminal. The input terminal of the first high-pass filter is interconnected to the left channel positive amplifier output terminal. The output terminal of the first high-pass filter is interconnected to the negative input terminal of the second rear loudspeaker system. The input terminal of the second high-pass filter is interconnected to the right channel positive amplifier output terminal. The output terminal of the second high-pass filter is interconnected to the negative input terminal of the first rear loudspeaker system. Each electronic matrix network also includes a resistive attenuation circuit whereby the output levels of the rear loudspeaker systems may be adjusted.

3 Claims, 1 Drawing Figure

TWO-CHANNEL, FOUR LOUDSPEAKER-COMPONENT ENHANCED STEROPHONIC SYSTEM

BACKGROUND OF THE INVENTION

1. Field of the Invention

The present invention relates to a two-channel, four loudspeaker-component enhanced stereophonic system, and more particularly to a stereophonic system having enclosures in each of which a front loudspeaker system and a rear loudspeaker system are placed and two electronic matrix networks which utilize two-channel information in driving each of the two rear loudspeaker systems.

2. Description of the Prior Art

U.S. Pat. No. 3,697,692, entitled Two-Channel, Four Component Stereophonic System, issued to David Hafler on Oct. 10, 1972, teaches a two-channel, four-component stereophonic system into which a two-channel stereo signal including left and right channel responses (L and R, respectively) derived from only two amplifiers is fed. The stereophonic system includes four speakers which are located approximately at the corners of a quadrilateral area and which are positioned so that each of them faces toward the interior of the area. An electronic network drives the four loudspeaker systems with four different signals, which have been derived from the original left and right channels, so that the sound from the loudspeaker systems appears to the listener, who is positioned interiorly of the area, to come from the four sides of the area rather than the four corners. The loudspeaker systems in the left and right front corners respond to (L+R/2) and (R+L/2), respectively, while in the left and right rear corners the loudspeaker systems respond to (L−R/2) and (R−L/2), respectively.

U.S. Pat. No. 4,191,852, entitled Stereophonic Sense Enhancing Apparatus, issued to Masao Nishikawa on Mar. 4, 1980, teaches an apparatus for effectively increasing stereophonic sense when the distance between the left and right loudspeakers is small. The apparatus enlarges the apparent distance between the left and right sources of sound by vectorially adding the sound signals of the left and right channels. The apparatus has a phase reversing circuit, a mixer circuit, and a band-pass filter in each of the left and the right channels. The phase reversing circuit is a negative feedback type tone control circuit. The mixer circuit includes a stereophonic sense increasing effect on-off switch device which is capable of switching load impedances. The band-pass filter passes a sound frequency band that is useful for increasing the stereophonic sense.

U.S. Pat. Nos. 3,164,676, 3,637,938 and 3,632,886 all teach enhanced stereophonic systems. All of the above enhanced stereophonic systems have their front and rear loudspeaker systems mounted in separate enclosures each of which is placed in separate positions in the room. It would be far more convenient, as well as sonically more accurate, to place each set of front and rear loudspeaker systems in a single enclosure with the front loudspeaker system mounted in such a way as to face the listener, and the rear loudspeaker system mounted in such a way as to face the wall behind the enclosure, and with the electronic matrix networks converting both left and right channel amplifier signals into each of the two new rear channel signals for the purpose of driving the rear loudspeaker systems. It would also be sonically more accurate to apply the left and right channel amplifier signals directly to the left and right front loudspeaker systems, respectively. It should be noted that stereophonic systems have been built and marketed which have separate rear-facing loudspeaker systems. However, these stereophonic systems do not have any electronic matrix type networks driving the rear loudspeaker systems.

One of the problems confronted with a front loudspeaker system and a rear loudspeaker system mounted in the same enclosure and in which the rear loudspeaker system is driven by an electronic matrix network is that sound energy of lower frequencies produced by the rear loudspeaker system interfere with the sound produced by the front loudspeaker system thereby causing a form of distortion. In order to place the front and rear loudspeaker systems in the same enclosure without producing such distortion, lower frequency sound energy must be eliminated from the rear loudspeaker system. The wavelength of the cut-off frequency for the appropriate high-pass filter should not generally exceed two times the smallest dimension of the baffle board on which the rear loudspeaker system is mounted.

SUMMARY OF THE INVENTION

In view of the foregoing factors and conditions which are characteristic of the prior art it is a primary object of the present invention to provide a two-channel, four loudspeaker-component enhanced stereophonic system having two enclosures in each of which a front loudspeaker system and a rear loudspeaker system are placed with the left and right front loudspeaker systems directly interconnected to the left and right channel amplifier signals and with an electronic matrix network serving to generate two new channels of information each of which has been derived from the left and right amplifier signals and in which the two new channels separately drive the rear loudspeaker systems.

It is another object of the present invention to provide high-pass filters for the purpose of eliminating lower frequencies from the rear loudspeaker systems which are driven by matrix type networks and which are placed in common enclosures with the front loudspeaker systems in order that such low frequency energy will not intefere with the sound produced by the front loudspeaker systems.

In accordance with an embodiment of the present invention an improved two-channel, four loudspeaker-component enhanced stereophonic system is described. The enhanced stereophonic system includes a pair of front loudspeaker systems, a pair of rear loudspeaker systems and a pair of speaker enclosures into each of which one of the front loudspeaker systems and one of the rear loudspeaker systems are placed. The enhanced stereophonic system also includes two electronic matrix networks which interconnect the input terminals of each front loudspeaker system to the left and right channel amplifier output terminals, respectively, and which also interconnect the positive input terminal of each rear loudspeaker system to the left and right channel positive amplifier output terminals, respectively. The electronic matrix networks include a first high-pass filter and a second high-pass filter each of which has an input terminal and an output terminal. The input terminal of the first high-pass filter is interconnected to the left channel positive amplifier output terminal. The output terminal of the first high-pass filter is interconnected to the negative input terminal of the second rear loudspeaker system. The input terminal of the second high-pass filter is interconnected to the right channel positive amplifier output terminal. The output terminal of the second high-pass filter is interconnected to the negative input terminal of the first rear loudspeaker system. Each electronic matrix network also includes a resistive attenuation circuit whereby the output levels of the rear loudspeaker systems may be adjusted. The electronic matrix networks allow the left and right channels to be vectorally subtracted in the two rear loudspeaker systems in order to provide sound which appears to emanate from behind both of the speaker enclosures.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
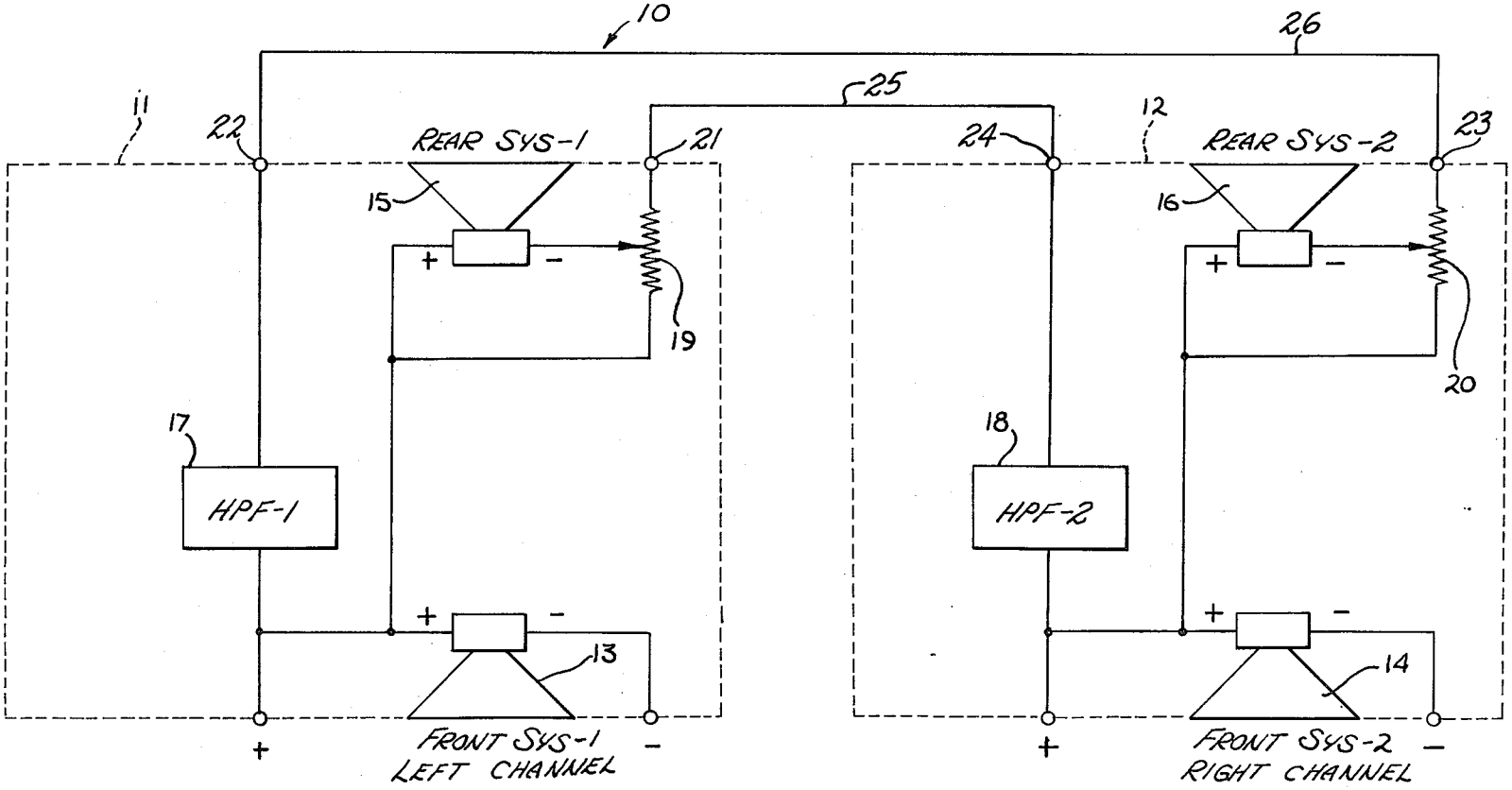
FIG. 1 is a schematic drawing of a pair of front loudspeaker systems, a pair of rear loudspeaker systems and a pair of speaker enclosures into each of which one of the front loudspeaker systems and one of the rear loudspeaker systems are placed with two electronic matrix networks which have been constructed in accordance with the principles of the present invention and which utilize two-channel information in driving each of the two rear loudspeaker systems.

In order to best understand the present invention it is necessary to refer to the following description of its preferred embodiment in conjunction with the accompanying drawing. Referring to FIG. 1 an improved two-channel, four loudspeaker-component enhanced stereophonic system 10 includes a first speaker enclosure 11 and a sound speaker enclosure 12. The enhanced stereophonic system 10 also includes a first front loudspeaker system 13, a second front loudspeaker system 14, a first rear loudspeaker system 15 and a second rear loudspeaker system 16. The first front and rear loudspeaker systems 13 and 15 are placed in the first speaker enclosure 11. The second front and rear loudspeaker systems 14 and 16 are placed in the second speaker enclosure 12. The enhanced stereophonic system 10 further includes a first electronic matrix network and a second electronic matrix network which include a first high-pass filter 17, a second high-pass filter 18, a first potentiometer 19 and a second potentiometer 20. Each of the high-pass filters 17 and 18 has an input terminal and an output terminal.

The first electronic matrix network electrically interconnects the positive and negative input terminals of the first front loudspeaker system 13 to the left channel positive and negative amplifier output terminals, respectively. The first electronic matrix network also electrically interconnects the positive input terminal of the first rear loudspeaker system 15 to the left channel positive amplifier output terminal. The first electronic matrix network further electrically interconnects the first potentiometer 19 to the left channel positive amplifier output terminal, the negative terminal of the first rear loudspeaker system 15 and a first interconnection terminal 21. The input terminal of the first high-pass filter 17 is electrically interconnected to the positive left channel amplifier output terminal. The output terminal of the first high-pass filter 17 is electrically interconnected to a second interconnection terminal 22.

The second electronic matrix network electrically interconnects the positive and negative input terminals of the second front loudspeaker system 14 to the right channel positive and negative amplifier output terminals, respectively. The second electronic matrix network also electrically interconnects the positive input terminal of the second rear loudspeaker system 16 to the right channel positive amplifier output terminal. The second electronic matrix network further electrically interconnects the second potentiometer 20 to the right channel positive amplifier output terminal, the negative input terminal of the second rear loudspeaker system 16 and a third interconnection terminal 23. The input terminal of the second high-pass filter 18 is electrically interconnected to the positive right channel amplifier output terminal. The output terminal of the second high-pass filter 18 is electrically interconnected to a fourth interconnection terminal 24.

The first and second electronic matrix networks are electrically interconnected by a first wire 25 between the first and fourth interconnection terminals 21 and 24 and by a second wire 26 between the second and third interconnection terminals 22 and 23 so that the left and right channels are vectorally subtracted in the first and second rear loudspeaker systems 15 and 16 in order to provide sound which appears to emanate from behind both of the speaker enclosures 11 and 12. The first and second potentiometer 19 and 20 are used to adjust the output levels of the first and second rear loudspeaker systems 15 and 16.

From the foregoing it can be seen that an improved two-channel, four loudspeaker-component enhanced stereophonic system has been described. It should be noted that the specific arrangement of the electronic matrix networks may be altered in accordance with the principles of the present invention.

Accordingly it is intended that the foregoing disclosure and showing made in the accompanying drawing shall be considered only as illustrations of the principles of the present invention.

What is claimed is:

1. In a two-channel, four loudspeaker-component enhanced stereophonic system which receives a two-channel stereophonic signal including left and right channels which are derived from two amplifiers and which include:

a. a first front loudspeaker system having a positive terminal and a negative terminal;

b. a second front loudspeaker system having a positive terminal and a negative terminal;

c. a first rear loudspeaker system having a positive terminal and a negative terminal;

d. a second rear loudspeaker system having a positive terminal and a negative terminal, an improvement comprising:

a. a first speaker enclosure having a top, a back, a pair of sides, a bottom and a front, the front having a speaker opening wherein the first front loudspeaker may project sound outwardly therefrom and the back having a speaker opening wherein the first rear loudspeaker may project sound outwardly therefrom in the opposite direction;

b. a second speaker enclosure having a top, a back, a pair of sides, a bottom and a front, the front having a speaker opening wherein the second front loudspeaker may project sound outwardly therefrom and the back having a speaker opening wherein the second rear loudspeaker may project sound outwardly therefrom in the opposite direction;

c. a first electronic matrix network for interconnecting the positive terminal of the first front loudspeaker system and the negative terminal of the second rear loudspeaker system; and d. a second electronic matrix network, which is identical to said first electronic matrix network, for interconnecting the positive terminal of the second front loudspeaker system and the negative terminal of the first rear loudspeaker system whereby the first and second loudspeaker systems are directly interconnected to the corresponding amplifier channel signals and whereby the left and right channel signals are subtracted in the two rear loudspeaker systems in order to provide sounds which appears to emanate from behind both of said first and second speaker enclosures.

2. In a two-channel, four loudspeaker-component enhanced stereophonic system an improvement according to claim 1 wherein said first and second identical electronic matrix networks comprise:

a. first interconnecting means for electrically interconnecting the positive and negative terminals of the first front loudspeaker system to the positive and negative left channel amplifier output terminals, respectively;

b. second interconnecting means for electrically interconnecting the positive and negative terminals of the second front loudspeaker system to the positive and negative right channel amplifier output terminals, respectively;

c. third interconnecting means for electrically interconnecting the positive terminal of the first rear loudspeaker system to the positive left channel amplifier output terminal;

d. fourth interconnecting means for electrically interconnecting the positive terminal of the second rear loudspeaker system to the positive right channel amplifier output terminal;

e. a first high-pass filter which has an input terminal and an output terminal with said input terminal of said first high-pass filter being electrically coupled to the positive left channel amplifier output terminal;

f. a second high-pass filter which has an input terminal and an output terminal with said input terminal of said second high-pass filter being electrically coupled to the positive right channel amplifier output terminal;

g. fifth interconnecting means for electrically interconnecting said output terminal of said first high-pass filter to the negative input terminal of the second rear loudspeaker system; and h. sixth interconnecting means for electrically interconnecting said output terminal of said second high-pass filter to the negative input terminal of the first rear loudspeaker system.

3. In a two-channel, four loudspeaker-component enhanced stereophonic system an improvement according to claim 2 wherein said first and second identical electronic matrix networks comprise:

a. a first resistive attenuation circuit which electrically couples the positive and negative input terminals of the first rear loudspeaker system to said third interconnecting means and to said output terminal of said second high-pass filter, respectively; and b. a second resistive attenuation circuit which electrically couples the positive and negative input terminals of the second rear loudspeaker system to said fourth interconnecting means and to said output terminal of said first high-pass filter, respectively, whereby said first and second resistive attenuation circuits adjust the output levels of the first and second rear loudspeaker systems, respectively.

* * * * *